US006675402B1

(12) United States Patent
Maurer

(10) Patent No.: US 6,675,402 B1
(45) Date of Patent: Jan. 13, 2004

(54) SWIMMING POOL COPING

(75) Inventor: Ronald L. Maurer, Indianapolis, IN (US)

(73) Assignee: Centura Solid Surfacing, Inc., Westfield, IN (US)

( * ) Notice: Subject to any disclaimer, the term of this patent is extended or adjusted under 35 U.S.C. 154(b) by 30 days.

(21) Appl. No.: 10/159,455

(22) Filed: May 31, 2002

(51) Int. Cl.[7] ..... E04H 4/00

(52) U.S. Cl. ..... 4/506; 52/102; 52/716.2; 52/169.7

(58) Field of Search ..... 4/506, 496, 504, 4/488; 52/300, 169.7, 102, 716.2

(56) References Cited

U.S. PATENT DOCUMENTS 3,427,663 A * 2/1969 O'Connell et al. ..... 52/716.2
3,535,840 A * 10/1970 Fontana ..... 52/177
3,634,892 A * 1/1972 Rains ..... 52/716.2
3,811,236 A * 5/1974 Fiddes ..... 52/102
4,457,119 A * 7/1984 Dahowski ..... 52/300

* cited by examiner

*Primary Examiner*—Gregory Huson
*Assistant Examiner*—Huyen Le
(74) *Attorney, Agent, or Firm*—Woodard, Emhardt, Moriarty, McNett & Henry LLP

(57) ABSTRACT

A swimming pool coping install able around the periphery of a swimming pool. The coping is formed of a plurality of coping members each of which is a solid molded body composed of solid surfacing material having one or more additives or fillers incorporated therein to enhance properties of the body as a swimming pool coping The coping is highly durable, easy to install and maintain and provides a very attractive appearance.

17 Claims, 3 Drawing Sheets

SWIMMING POOL COPING

BACKGROUND OF THE INVENTION

1. Field of the Invention

The present invention relates generally to the field of swimming pool copings; and, more particularly, to a swimming pool coping member constructed of solid surfacing material.

2. Description of the Prior Art

A swimming pool coping is a structure which functions to cap the upper edge of the side walls of a swimming pool and to provide a transitional element between the side walls and the horizontal deck surrounding the pool. Usually, the coping extends around the periphery of the pool and includes a convex-shaped rounded portion which faces toward the interior of the pool and serves as a hand hold for swimmers to rest or to climb into or out of the pool. In swimming pools which have a vinyl liner, the coping often includes a portion which extends downwardly somewhat along the side walls of the pool and which has a slot or other structure for receiving and retaining a bead disposed at the top edge of the liner. Such copings may also be designed to include structures to receive and retain lights or other accessories for use in the pool.

Swimming pool copings are constructed of various materials including cement, brick, stone, aluminum and plastic; however, such materials are not always fully satisfactory. In particular, because of its location around the edge of the swimming pool, the coping is subjected to substantial use and is frequently abused. For example, it is constantly being stepped on and jumped on and is often hit by toys, pool servicing equipment and other items carried in or around the pool. Copings constructed of cement, stone or brick can chip or crack as a result of such use not only creating an unsightly appearance, but also providing locations where water can collect. Such standing water can provide a breeding ground for algae, mildew and the like; and, if allowed to freeze, can cause significant damage to the coping and to the overall structure of the pool. Cement is also rather porous and can retain water even when not damaged.

Although coping materials such as stone, brick and cement are often repairable as by patching, replacing bricks, etc. the repairs are often costly and not fully satisfactory because the patches or new materials are usually much brighter in color than the original materials and thus detract from the appearance of the coping. Copings formed of plastic are usually also not fully satisfactory as they are difficult to repair and are often rather flimsy and become wavy or otherwise misshapen over time. Aluminum copings can bend and also become deformed over a period of time.

SUMMARY OF THE INVENTION

The present invention provides a swimming pool coping member that is highly durable, easy to install and maintain and very attractive in appearance. A swimming pool coping member according to the present invention is adapted to be installed around at least a portion of a periphery of a swimming pool and comprises a solid molded body composed of solid surfacing material having one or more additives or fillers incorporated therein for enhancing properties of the body as a coping member, the solid surfacing material comprising a material which is cast or extruded, colored throughout, and about 98 percent or more de-aired, and which comprises a resin selected from the group consisting of polyester, acrylic or a combination thereof, and an inert filler which functions as an extender for the resin.

Solid surfacing material possesses numerous properties which make it especially suitable as a swimming pool coping including being non-porous and thus highly water-resistant, and extremely durable. Solid surfacing material also has chemical resistance, stain resistance and a high degree of repairability all important properties of a good swimming pool coping.

A swimming pool coping member according to the present invention can be provided in any desired color; and because the coloring in a solid surfacing material extends throughout the body of the member rather than being painted on or otherwise applied to the surface of the member, the color will tend to retain its appearance and not fade or otherwise deteriorate over time as rapidly as with many existing coping materials.

According to presently preferred embodiments of the invention, various additives or filler materials are incorporated into the solid surfacing material formulation to enhance the properties of the member as a swimming pool coping. For example, as indicated above, coloring agents can be added to the formulation to provide the coping in a desired color. Also, if desired, a suitable inhibitor can be added to increase the flexibility or resiliency of the solid surfacing material somewhat so that it is better able to resist chipping or cracking due to impacts or the like. An appropriate algaecide can also be added to the formulation to combat the growth of algae around the pool which is often a significant problem with some swimming pools, although solid surfacing material, due to its non-porous nature, has a high resistance to the growth of algae, mildew and the like in any event. A UV stabilizer may also be added to further increase the resistance of the member to deterioration by sunlight. These various additives and fillers can all be added to the solid surfacing material formulation prior to the molding of the member.

An important aspect of the present invention is that the swimming pool coping member is capable of being easily repaired. In particular, chips or cracks In the coping can often be readily repaired by simply filling them in utilizing a conventional solid surfacing material repair kit, and then sanding the repaired surface as appropriate. This is an important advantage over many conventional coping materials which often cannot be easily repaired. More significantly damaged members can be repaired by cutting away the damaged member and replacing it with a new section. Such new section can be blended into the existing section, if desired, to provide a smooth, substantially seamless appearance.

Another important aspect of the coping member of the present invention is that it provides tremendous flexibility in design. For example, as indicated above, it can be provided in essentially any desired color. Thus, it can be colored to match or contrast with the color of the pool deck, pool furniture or other articles used in or around the pool. The coping member can also easily be provided with inlaid portions in any desired pattern or design in the same or a different color. For example, a design can be laser engraved or sandblasted on the surface of the member and then filled in by solid surfacing material of a different color or by another material and finished to provide a very attractive appearance. The surface of the member can also be textured in any desired manner, if desired, for attractiveness and/or to provide a non-slip surface.

The coping member of the present invention can be manufactured in convenient sizes of, for example, two feet lengths; and applied side-by-side around the periphery of the pool by laying the members in a layer of cement or the like. The separate members or coping sections could be grouted or, if desired, the members could be blended together to provide the appearance of a continuous one-piece coping. The coping members will often be lighter in weight than conventional coping materials and thus will be less costly to ship and easier to handle.

Further advantages and specific features of the present invention will become apparent hereinafter in conjunction with the following detailed description of presently preferred embodiments.

DETAILED DESCRIPTION OF THE PREFERRED EMBODIMENTS

Figure 1:
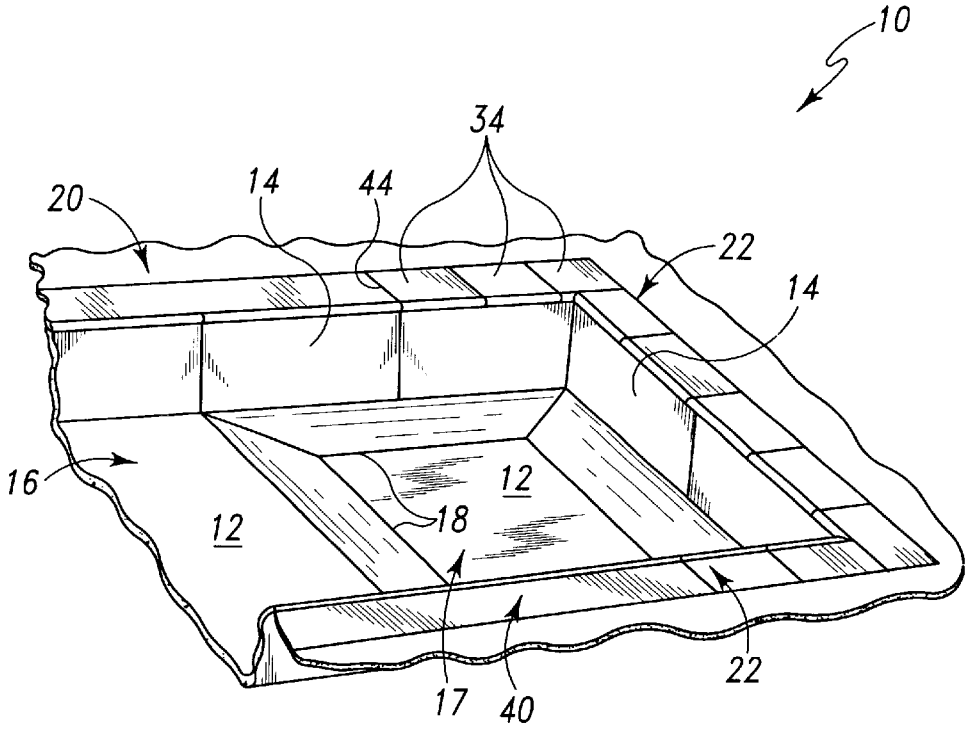
FIG. 1 illustrates a portion of a swimming pool incorporating a swimming pool coping according to a presently preferred embodiment of the present invention.

FIG. 1 illustrates a swimming pool of generally conventional type with which the swimming pool coping member of the present invention may be utilized. The swimming pool is generally designated by reference number 10 and includes a bottom 12 and side walls 14. As is well-known, the pool may include a shallow portion 16 and a deeper portion 17 joined together by an inclined portion 18 of the bottom 12.

Reference number 20 indicates the deck or walkway surrounding the pool, and swimming pool coping 22 extends around the pool, and connects the side walls 14 of the pool to the deck 20 as is known to those skilled in the art.

Figure 2:
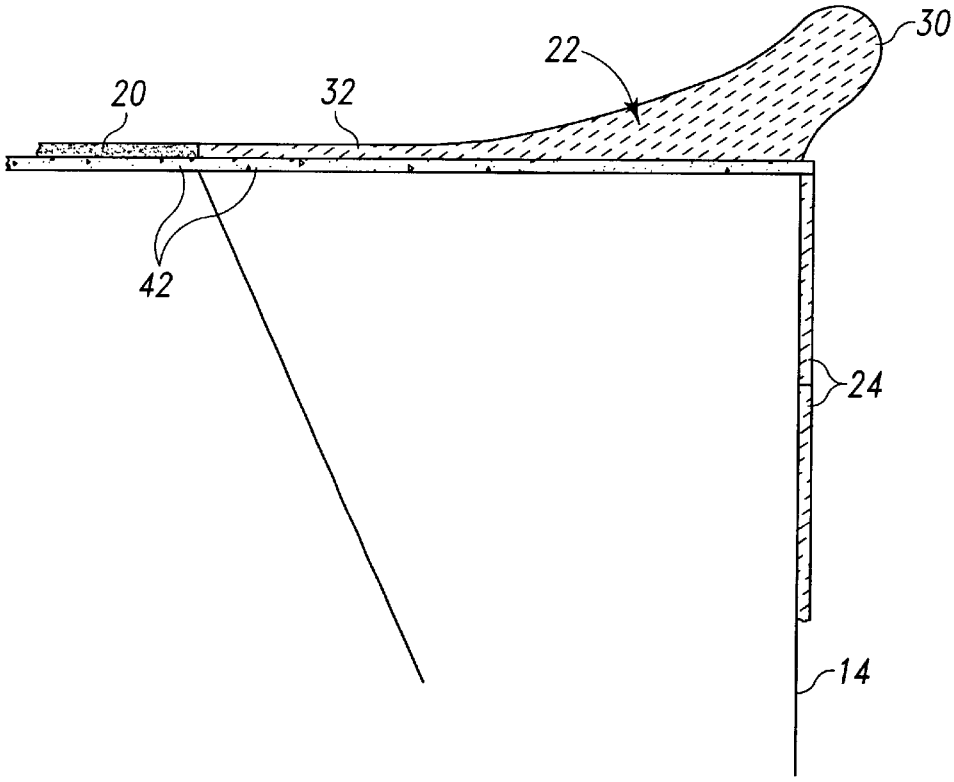
FIG. 2 is a cross-sectional view of the upper edge of the swimming pool of FIG. 1.

Specifically, as shown more clearly in FIG. 2, the side walls 14 of the pool are typically constructed of cement or the like and extend upwardly from the bottom of the pool. The walls are typically about 4 to 6 inches thick but increase to a thickness of 10–12 inches adjacent the top end thereof in order to accommodate the width of the coping and to provide structural strength and integrity to this rather sensitive area of the pool.

Often, a row or two of tiles 24 are attached to the side walls of the pool around the top thereof to a depth of, for example, 6 to 12 inches (see FIG. 2). The tiles provide an attractive accent to the pool's edge while serving as an easily cleanable surface.

The coping 22 surrounds the pool, and, in effect, serves to cap the side walls of the pool and to connect the side walls to the deck 20 around the pool. In the embodiment shown in FIG. 2, the coping is about 12 inches wide and includes a convex-shaped inwardly facing rounded portion 30 and a generally flat, tapered portion 32 which extends from the rounded portion to the deck around the pool. The rounded portion 30 functions to provide a handhold for swimmers to rest or to climb into or out of the pool, while the flat portion 32 tapers down from the rounded portion to the deck to provide a smooth transition with the deck. The coping 22 is about two inches thick adjacent the rounded portion 30 and tapers down to a thickness of about ¾ inch adjacent the deck 20.

It should be understood that the particular coping design shown in FIG. 2 is intended to be exemplary only as the coping can be designed to have any appropriate configuration. It should also be understood that in pools with vinyl liners, the coping often extends downwardly somewhat along the side walls of the pool and includes a groove or similar structure to receive and retain the upper beaded end of the liner. The coping of the present invention is also intended to cover such embodiments as well.

The swimming pool coping of the present invention is constructed of solid surfacing material which provides the coping with numerous advantageous features typically not found in conventional coping materials. A solid surfacing material is generally recognized in the industry as comprising a product which is cast or extruded, colored throughout and 98 percent or more de-aired, utilizing a matrix consisting of a resin (for example, polyester, acrylic or a combination thereof) and inert fillers, most commonly aluminum trihydrate (A TH) which functions as an extender for the resin and which is a well-known fire retardant and thus renders the coping as a whole highly fire-resistant.

Solid surfacing materials are available in the marketplace from various sources, for example, under the trademark CENTURA available from Centura Solid Surfacing, Inc. of Westfield, Ind., and under the trademark CORIAN available from DuPont; and, accordingly, specifics of its manufacture need not be recited herein in any substantial detail. CENTURA solid surfacing material is a rigid, de-aired material composed primarily of a thermoset polyester component, while CORIAN solid surfacing material is believed to be a substantially rigid, non-foamed, non-laminated or coated material composed primarily of thermoformed acrylic components.

In general, a solid surfacing material may be manufactured by mixing an unsaturated polyester resin with aluminum trihydrate of the appropriate particle size. Appropriate additives and colorants may also be added to the mix, depending on the particular application in which the finished article is to be used. The mix is then homogenized in a vacuum mixer forcing air from the product so that the product is 98 percent or more de-aired. After a short mixing cycle, the mix is then transferred into a mold and then molded; and when ready, the molded article is demolded and finished as appropriate or desired.

The molded article may be fabricated by injection molding, extrusion molding, bulk molding compounding (BMC) and other molding techniques to achieve article that is highly chemical resistant, stain resistant and repairable and that can 1~tooled into many shapes and designs using common woodworking tools. Because it is a fully densified product, it has a non-porous surface which is a highly desirable property for a swimming pool coping.

A swimming pool coping member according to the present invention may be molded in an open-faced cavity. The mold may be formed of silicone rubber or other deformable material to facilitate removal of the member from the mold after completion of the molding process. When molding by other techniques such as, for example, bulk molding compounding, a rigid mold such as a stainless steel mold is generally preferred.

After removal from the mold, the member can be sanded and/or otherwise finished as desired for a particular application. For example, the surface thereof can be brushed or otherwise treated to provide it with a desired texture or appearance and/or to provide it with a non-slip surface.

In accordance with preferred embodiments of the present invention, various additives and fillers are added to the solid surfacing material formulation to enhance its properties and characteristics as a swimming pool coping. For example, as indicated above, colorants are preferably added to provide the coping in a desired color. Preferably also, a UV inhibitor is added to the mix to resist fading of the color. In addition, although solid surfacing material, by virtue of its being a highly non-porous material, tends to inhibit the growth of algae, mildew or the like, which is a particularly important property in the environment of a swimming pool; if desired, a suitable algaecide or the like can be added to the formulation to further inhibit such growth.

In addition, if desired, a lightweight filler such as a quantity of hollow microspheres or the like can be added to the mix to reduce the weight of the member so as to make it less-expensive to transport and easier to handle. Also, a small amount of an additive such as an inhibitor may be added to the formulation to increase the resiliency of the member somewhat so as to enable it to better withstand impacts without chipping or cracking. Such an inhibitor may comprise a quinone inhibitor such as toluhydroquinone which is believed to function by preventing a 100 percent cure of the solid surfacing material and thus renders the member somewhat more flexible or resilient.

An important aspect of the coping of the present invention is that it is readily repairable. In particular, with the present invention, small cracks or chips in a coping member can easily be repaired at the pool by utilizing a commercially available solid surfacing material repair kit such as is marketed by Centura Solid Surfacing, Inc., and then sanding the repaired surface as appropriate. Use of the repair kit provides a generally seamless repair and greatly facilitates maintenance of the coping.

As shown in FIG. 1, the swimming pool coping of the present invention is conveniently formed of a plurality of separate coping members or sections 34 of, for example, two feet in length, with each section comprising a single, molded member of solid surfacing material. The sections can conveniently be applied on a base of cement as shown at 42 in FIG. 2; or, if preferred, secured in place by means of a suitable adhesive. Adjacent sections can be connected by a suitable grouting material 44 as shown in FIG. 1; or, alternatively, the sections can be blended together by solid surfacing material to provide the appearance of a single coping member (as schematically illustrated by the continuous sections 40 in FIG. 1).

Figure 3:
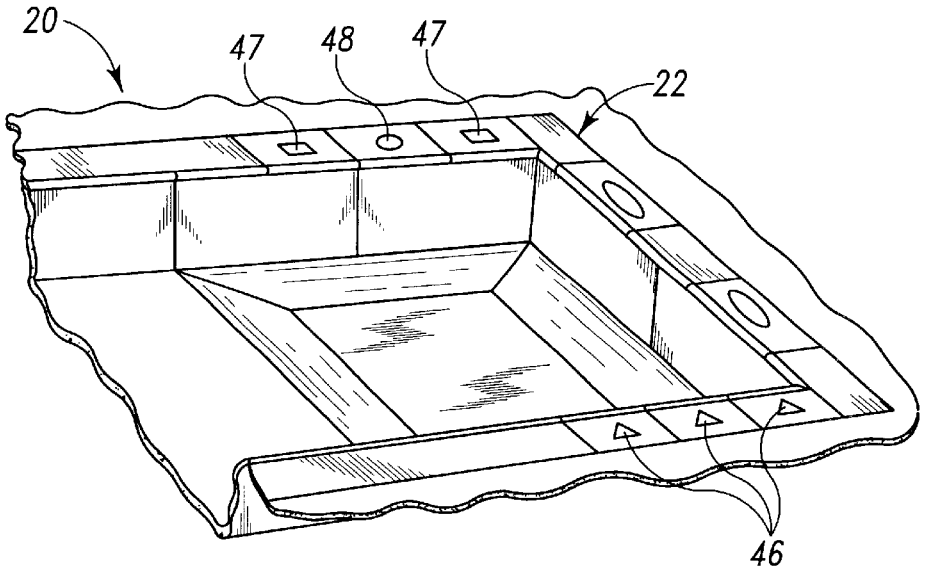
FIG. 3 illustrates a portion of a swimming pool incorporating a swimming pool coping according to alternative embodiments of the invention.

A swimming pool coping constructed of solid surfacing material provides a great deal of flexibility in designing the coping. As indicated above, for example, it can be manufactured in any desired color and thus can be colored to match or contrast with the color of the deck, of furniture used around the pool or of any other desired article in or around the pool. Different coping sections of the coping could also be made in different colors, if desired. It is also possible and relatively easy to form appropriate designs or patterns on the coping. For example, a pattern can be laser engraved or sandblasted onto the surface of each section and the pattern thus formed filled in with solid surfacing material of a contrasting color or of tile or other material to provide a coping having a very attractive appearance. As shown, for example, in FIG. 3, the same design 46 may be formed in each section or member 34 to provide a repetitive pattern around the pool, or different designs 47,48 in the same or different colors could be provided in different members arranged in different ways. An essentially endless number of design possibilities can be envisioned.

While what has been described constitutes presently preferred embodiments of the invention, it should be recognized that the invention could take numerous other forms. Accordingly, it should be understood that the invention should be limited only insofar as is required by the scope of the following claims.

What is claimed:

1. A swimming pool coping member comprising:

a solid molded body composed of solid surfacing material having one or more additives or fillers incorporated therein for enhancing properties of said body as a swimming pool coping member, said solid surfacing material comprising a material which is cast or extruded, colored throughout and about 98 percent or more de-aired and which comprises a resin selected from the group consisting of polyester, acrylic or a combination thereof, and an inert filler which functions as an extender for the resin.

2. The swimming pool coping member of claim 1 wherein said one or more additives or fillers includes a colorant incorporated in said solid surfacing material to provide said solid molded body in a desired color.

3. The swimming pool coping member of claim 1 wherein said one or more additives or fillers includes a UV stabilizer.

4. The swimming pool coping member of claim 1 wherein said one or more additives or fillers includes an algaecide.

5. The swimming pool coping member of claim 1 wherein said one or more additives or fillers includes a weight-reducing agent incorporated in said solid surfacing material to reduce the weight of said solid molded body.

6. The swimming pool coping member of claim 5 wherein said weight-reducing agent comprises a quantity of hollow microspheres.

7. The swimming pool coping member of claim 1 wherein said one or more additives or fillers includes an inhibitor to increase the resiliency of said solid molded body.

8. The swimming pool coping member of claim 7 wherein said inhibitor comprises toluhydroquinone.

9. The swimming pool coping member of claim 1 wherein said member comprises a generally rectangular-shaped member, and wherein a plurality of members are positionable around the swimming pool to provide a coping structure.

10. The swimming pool coping member of claim 9 wherein each member includes a convex-shaped rounded portion facing inwardly of the swimming pool when the members are positioned around the swimming pool.

11. The swimming pool coping member of claim 9 wherein at least some of said plurality of members include a design provided on an upper surface thereof.

12. The swimming pool coping member of claim 11~herein said design comprises a solid surfacing material in a color different from a color of said member.

13. A swimming pool coping installable around at least a portion of a periphery of a swimming pool, said swimming pool coping comprising a plurality of coping members, each coping member comprising a solid molded body composed of solid surfacing material having one or more additives or fillers incorporated therein for enhancing properties of the body as a coping member, said solid surfacing material comprising a material which is cast or extruded, colored throughout, and about 98 percent or more de-aired, and which comprises a resin selected from the group consisting of polyester, acrylic or a combination thereof, and an inert filler which functions as an extender for the resin.

14. The swimming pool coping of claim 13 wherein said plurality of coping members are installable side-by-side around the periphery of the swimming pool.

15. The swimming pool coping of claim 14 wherein ad, adjacent members are connected by a grouting material.

16. The swimming pool coping of claim 14 wherein adjacent members are blended together by solid surfacing material to provide the appearance of a single coping member.

17. The swimming pool coping of claim 13 wherein at least some of the plurality of members include a design on an upper surface thereof.

* * * * *